US005193499A

United States Patent [19]

Binversie et al.

[11] Patent Number: 5,193,499

[45] Date of Patent: Mar. 16, 1993

[54] CAST INTER-CYLINDER COOLING PASSAGE FOR INTERNAL COMBUSTION MOTORS

[75] Inventors: Gregory J. Binversie, Grayslake, Ill.; Joseph E. Capodarco, Kenosha, Wis.

[73] Assignee: Outboard Marine Corporation, Waukegan, Ill.

[21] Appl. No.: 831,525

[22] Filed: Feb. 5, 1992

[51] Int. Cl.[5] ..... F02F 7/00

[52] U.S. Cl. ..... 123/195 R; 123/73 PP; 123/41.74

[58] Field of Search ..... 123/41.74, 41.79, 65 W, 123/73 PP, 195 R

[56] References Cited

U.S. PATENT DOCUMENTS

| | | | |
|---|---|---|---|
| 4,401,061 | 8/1983 | Matsushita et al. | 123/41.79 |
| 4,802,447 | 2/1989 | Corbett | 123/73 PP |
| 4,880,047 | 11/1989 | VanRens | 164/45 |
| 5,054,537 | 10/1991 | Van Rens | 164/34 |

*Primary Examiner*—Noah P. Kamen

*Attorney, Agent, or Firm*—Welsh & Katz, Ltd.

[57] ABSTRACT

A motor block for a multiple cylinder internal combustion motor, particularly an outboard motor, has a cooling passage that is integrally cast as a part of the motor block casting that extends from a water jacket in the cylinder head area to a water jacket space that is provided between the banks of cylinders in the V-block motor.

16 Claims, 1 Drawing Sheet

CAST INTER-CYLINDER COOLING PASSAGE FOR INTERNAL COMBUSTION MOTORS

BACKGROUND OF THE INVENTION

The present invention generally relates to die casting of motor or engine blocks and more particularly relates to cooling aspects of such motor blocks.

The use of the lost foam casting process in the casting of motor blocks has resulted in substantial advantages in terms of manufacturing costs and the resulting motor. One of the distinct advantages is that a one piece casting can be manufactured using such a process wherein the casting includes components that previously had to be separately made and subsequently assembled during the manufacturing process. For example, the lost foam casting process can result in an exhaust manifold that is integrally formed with the motor block. The process also permits a motor to be made that is compact in design, but yet still has the desired power output. With a compact design, extreme care must be taken to provide adequate cooling of the motor block, particularly given the high heat output that occurs when such powerful motors are running at speed.

In a typical outboard motor having multiple cylinders, it is desirable to provide a cylinder bore geometry that is as round as possible and one of the factors which influences the roundness of the bore is the temperature uniformity in the cylinder wall and the adjacent area.

One method for achieving a uniform temperature distribution is to design the cylinder or motor block with a deep water jacket in the cylinder bore area. However, because of the advent of the use of helical transfer passages which extend the cylinder wall outwardly beyond the cylindrical shape of the cylinder bore and the necessity of having cylinders adjacent one another in cylinder banks, it is not always possible to extend the water jacket as deeply along the cylinder wall as is desired. Such a situation can result in cylinder bore distortion if there exists a hot area adjacent the cylinder bore that has not properly cooled.

In certain motor designs, including commercially available V-bank six-cylinder outboard motors which have two banks of three cylinders, there is a location that is difficult to cool because of the presence of intake ports and helical transfer passages in the immediate area between adjacent cylinders of each bank. This hot area has tended to pinch the center cylinder of a three cylinder bank which tended to force it out of round which can cause a premature wearing of the motor piston.

In certain commercially available engines, cooling of this area has been provided by drilling holes in the casting in this area. However, with improved engine designs which utilize the lost foam casting process, coupled with the use of the helical transfer passages, there is not sufficient room or access to easily accomplish such drilling, or if it is attempted, the desired wall thickness of the cylinder walls cannot be maintained with a single drilling. Also, because of typical helix angles that are present on most intake passages for two stroke motors, multiple drilling must be done at oblique angles which are difficult to make in production and are therefore expensive.

Accordingly, it is a primary object of the present invention to provide an improved cast motor block which includes a cooling passage in the area between adjacent cylinders in a motor of the type which has helical transfer passages and integrally cast intake ports.

Yet another object of the present invention is to provide such a motor block that has cooling passages between adjacent cylinders and between helical transfer passages in the immediately adjacent area, which can be integrally cast using a lost foam casting process.

BRIEF DESCRIPTION OF THE DRAWINGS

These and other advantages will become apparent upon reading the following detailed description, which referring to the attached drawings, in which.

DETAILED DESCRIPTION

Broadly stated, the present invention is directed to cast motor blocks for internal combustion motors, such as outboard motors. However, the invention is not limited to outboard motors, and may be employed with other types of motors. Also while it is particularly useful with motors having banks of three cylinders, it may be useful with motors having an additional or lesser number of cylinders. The motor block of the present invention has a cooling passage that is integrally cast as a part of the motor block casting that extends from a water jacket in the cylinder head area to a water jacket space that is provided between the banks of cylinders in a V-block motor. It should be understood that while outboard motors are typically cooled by water that is provided by the body of water in which the motor is running, other cooling fluids may also be used.

Figure 1:
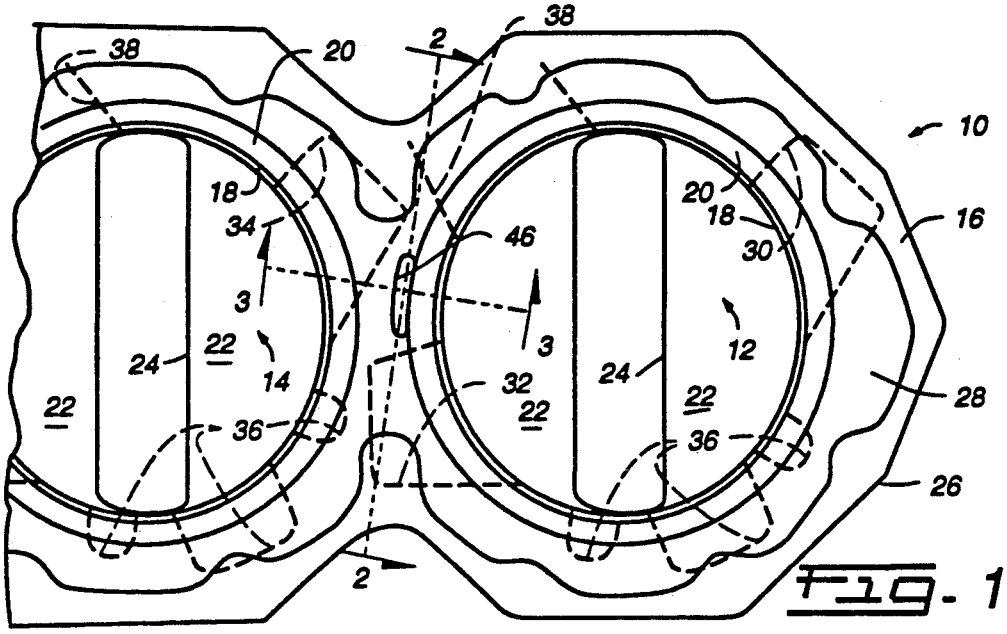
FIG. 1 is a plan view of the cylinder head face of one bank of cylinders of a motor block, illustrating two cylinders thereof and embodying the present invention.

Turning now to the drawings, and particularly FIG. 1, a motor block, indicated generally at 10, is shown to have two cylinder bores, indicated generally at 12 and 14. The block 10 has a cylinder head face 16 to which a cylinder head assembly (not shown) is later mounted during assembly of the motor. Each of the cylinder bores 12 and 14 is defined by a cylindrical sleeve 18 which is preferably made of steel and the sleeve 18 is placed in the pattern assembly before casting so that a cylinder wall 20 is cast around it. The bottom of the bore is defined by surfaces 22 in which an elongated slot 24 is provided through which connecting rods of the piston (not shown) can pass for connection to the crank case assembly (not shown). The block 10 has an outer wall 26 which extends completely around the periphery of the bank of cylinders and the space between the cylinder wall 20 and the outer wall 26 defines a head water jacket 28 through which water can pass for cooling the cylinder walls 20 and the adjacent area.

Figure 2:
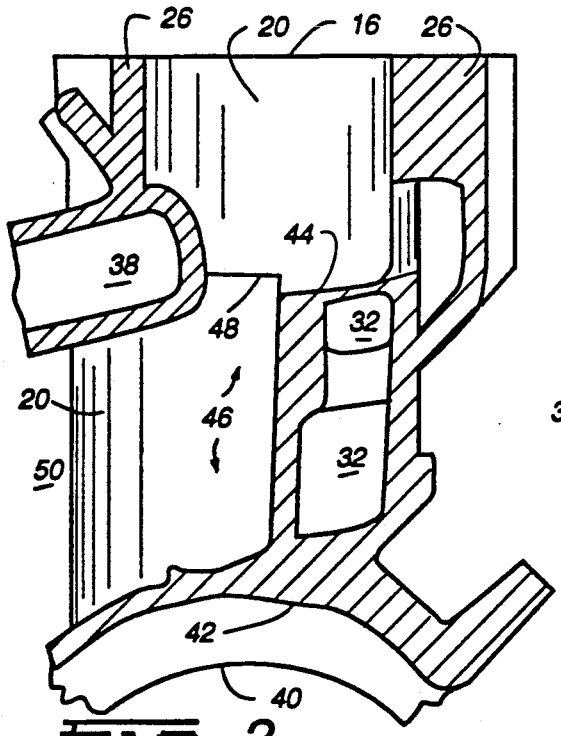
FIG. 2 is a cross-section taken generally along the line 2—2 of FIG. 1.
Figure 3:
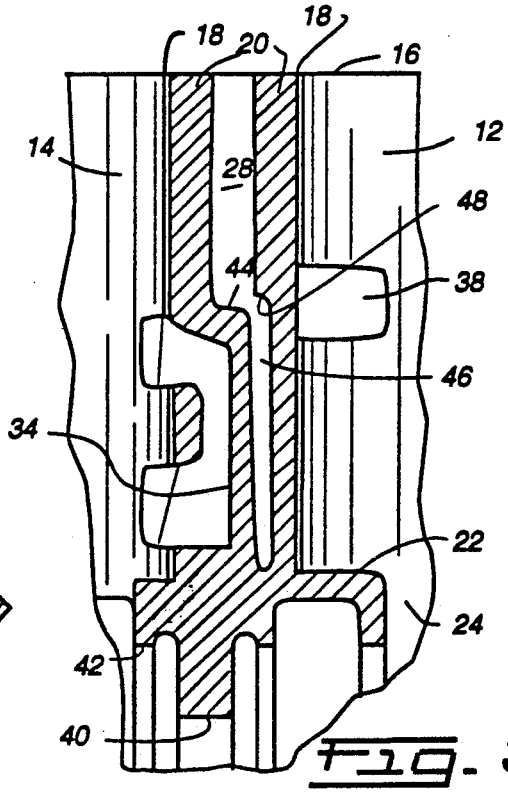
FIG. 3 is a cross-section taken generally along the line 3—3 of FIG. 1.

As is described in VanRens U.S. Pat. Nos. 4,880,047 and 5,054,537, which are assigned to the same assignee as the present invention, and which patents are specifically incorporated by reference herein, the construction of the cylindrical bores are such that helical transfer passages such as passage 30 and 32 are provided and which can broadly be described as recesses in the outer wall of the cylinder bore 12 which have been found to improve performance of the motor. A transfer passage 34, similar to the passage 30 of cylinder bore 12, is provided in the cylinder bore 14. Other recesses 36 are also provided in both cylinders and exhaust ports 38 are also shown. The lower part of the block includes curved crank case surfaces 40 and 42. In accordance with an important aspect of the present invention, cooling fluid, typically water, is pumped through the motor where it circulates in the head water jacket space 28 between the outer walls 26 and the cylinder walls 20. The depth of the water jacket is defined by surface 44 shown in FIGS. 2 and 3 and this distance between the cylinder head face 16 and the surface 44 is generally about ⅓ of the depth of the cylinder bore 12 which is shown in FIG. 3 to be the distance between the surface 16 and the surface 22. A passage 46 is located adjacent the cylinder wall 20 of cylinder 12 and is located in an area between the transfer passage 32 of cylinder 12 and the transfer passage 34 of cylinder 14. The passage 46 extends from the bottom surface 44 of the head water jacket 28 to approximately the bottom of the cylinder defined by surface 22.

As shown in FIG. 3, the upper portion of the passage 46 has an undercut shelf 48 that is located above the surface 44 to increase the cross-sectional area of the passage where it communicates with the head water jacket 28. As is shown in FIG. 2, the leftward side of the passage 46 communicates to a water jacket space, indicated generally at 50, which is present between the two banks of cylinders in a V-block multiple cylinder construction. It is preferred that the passage 46 extend substantially the remainder of the depth of the cylindrical bore from the location of the surface 44 which defined the bottom of the head water jacket 28 so that substantially the full length of the cylinder wall will be cooled by water flowing over it.

From the foregoing, it should be understood that an improved motor block construction has been shown and described which has many advantages in terms of manufacturing costs and reliability of operation of the motor. The presence of the passage that extends from the water jacket in the cylinder head area to the bottom of the cylinder bore in the area of the cylinder walls prevents uneven temperature distribution which could otherwise distort the cylinder bore of one or more cylinders of the motor. The casting of the passage during the casting of the motor block eliminates the need for expensive drilling after the motor block has been cast, and has a shape and size that contributes to more effective cooling of the cylinder walls during operation of the motor. While various embodiments of the present invention have been shown and described, it should be understood that various alternatives, substitutions and equivalents can be used, and the present invention should only be limited by the claims and equivalents thereof.

Various features of the present invention are set forth in the following claims.

What is claimed is:

1. A multiple cylinder motor block of the type which is used in marine and other internal combustion motors, said motor block comprising:

a unitary casting in which at least two cylinder bores of a predetermined depth are provided adjacent one another in at least one cylinder bank, with the casting defining cast cylinder walls around the bores;

each of the cylinder bores having at least one outwardly extending transfer passage located in its cylinder wall near the adjacent cylinder bore, each of said transfer passages having a helical relation to the axis of tis cylinder, the angular orientation of the transfer passage of one cylinder bore being different than the angular orientation of the near transfer passage of the adjacent cylinder to result in a portion of the casting between the two transfer passages;

each of said cylinder bores having a head end portion and a bottom end portion, said casting having outer walls spaced from the cylinder walls in said head end portion thereof to define a first cooling passage that extends circumferentially around each cylinder wall for receiving cooling fluid for cooling the cylinder walls, said first cooling passage extending from the head end of the casting to a first predetermined depth of the cylinder bore;

said casting having a second cooling passage extending from said first cooling passage to the exterior of the casting substantially along the length of the remainder of the cylinder bore depth, said second cooling passage being located between said near transfer passages of each set of adjacent cylinder bores in said portion of the casting between said two near transfer passages.

2. A motor block as defined in claim 1 having a fluid jacket space through which cooling fluid can pass, said second cooling passage communicating said first cooling passage with said fluid jacket space.

3. A motor block as defined in claim 1 wherein said second cooling passage extends from said first cooling passage to approximately the bottom the cylinder bore.

4. A motor block as defined in claim 1 wherein said first predetermined depth is about one third of the depth of the cylinder bore.

5. A motor block as defined in claim 4 wherein said second cooling passage extends from a position about one third of the depth of the cylinder bore to a position that is generally at the bottom of the cylinder bore.

6. A motor block as defined in claim 1 wherein said second cooling passage has a elongated cross sectional configuration, the length of which is approximately parallel to the portion of the cylinder wall immediately adjacent said second cooling passage.

7. A motor block as defined in claim 6 wherein the length of said elongated cross sectional configuration of said second cooling passage is the length of circumference of cylinder wall that equates to an arc of the cylinder wall that is within the range of approximately 10 to 15 degrees.

8. A motor block as defined in claim 1 wherein said second cooling passage is formed in said casting during the casting thereof.

9. A multiple cylinder motor block of the type which is used in marine and other internal combustion motors, said mot block comprising:

a unitary casting in which at least two cylinder bores of a predetermined depth are provided adjacent one another in at least one cylinder bank, with the casting defining cast cylinder walls around the bores;

each of the cylinder bores having at least one transfer passage located in its cylinder wall near the adjacent cylinder bore, each of said transfer passages extending outwardly of the cylinder bore and having a helical relation to the axis of its cylinder, the position of the transfer passage of one cylinder bore being laterally spaced from near transfer passage of the adjacent cylinder to provide a first volume of the casting located between the two transfer passages;

each of said cylinder bores having a head end portion and a bottom end portion, said casting having outer walls spaced from the cylinder walls in said head end portion thereof to define a first cooling passage that extends circumferentially around each cylinder wall for receiving cooling fluid for cooling the cylinder walls, said first cooling passage extending from the head end of the casting to a first predetermined depth of the cylinder bore;

said casting heaving a second cooling passage extending from said first cooling passage to the exterior of the casting substantially along the length of the remainder of the cylinder bore depth, said second cooling passage being located between said near transfer passages of each set of adjacent cylinder bores in said first volume of the casting.

10. A motor block as defined in claim 9 having a fluid jacket space through which cooling fluid can pass, said second cooling passage communicating said first cooling passage with said fluid jacket space.

11. A motor block as defined in claim 9 wherein said second cooling passage extends from said first cooling passage to approximately the bottom the cylinder bore.

12. A motor block as defined in claim 9 wherein said first predetermined depth is about one third of the depth of the cylinder bore.

13. A motor block as defined in claim 9 wherein said second cooling passage extends from said first predetermined depth that is at a position about one third of the depth of the cylinder bore to a position that is generally at the bottom of the cylinder bore.

14. A motor block as defined in claim 9 wherein said second cooling passage has a elongated cross sectional configuration, the length of which is approximately parallel to the portion of the cylinder wall immediately adjacent said second cooling passage.

15. A motor block as defined in claim 14 wherein the length of said elongated cross sectional configuration of said second cooling passage is the length of circumference of cylinder wall that equates to an arc of the cylinder wall that is within the range of approximately 10 to 15 degrees.

16. A motor block as defined in claim 9 wherein said second cooling passage is formed in said casting during the casting thereof.

* * * * *